US010675637B2

(12) United States Patent
Incera Garrido et al.

(10) Patent No.: US 10,675,637 B2
(45) Date of Patent: Jun. 9, 2020

(54) MAGNET ARRANGEMENT FOR TRANSPORTING MAGNETIZED MATERIAL

(71) Applicant: BASF SE, Ludwigshafen (DE)

(72) Inventors: Gerardo Incera Garrido, Viernheim (DE); Reinhold Rieger, Mutterstadt (DE); Miguel A. Romero Valle, Heidelberg (DE)

(73) Assignee: BASF SE (DE)

( * ) Notice: Subject to any disclaimer, the term of this patent is extended or adjusted under 35 U.S.C. 154(b) by 453 days.

(21) Appl. No.: 15/128,447

(22) PCT Filed: Mar. 18, 2015

(86) PCT No.: PCT/EP2015/055712
§ 371 (c)(1),
(2) Date: Sep. 23, 2016

(87) PCT Pub. No.: WO2015/150081
PCT Pub. Date: Oct. 8, 2015

(65) Prior Publication Data

US 2018/0169664 A1 Jun. 21, 2018

(30) Foreign Application Priority Data

Mar. 31, 2014 (EP) ..... 14162862

(51) Int. Cl.
*B03C 1/03* (2006.01)
*B03C 1/033* (2006.01)
(Continued)

(52) U.S. Cl.
CPC ..... *B03C 1/03* (2013.01); *B03C 1/034* (2013.01); *B03C 1/0332* (2013.01); *B03C 1/288* (2013.01);
(Continued)

(58) Field of Classification Search
CPC ..... B03C 1/03; B03C 1/034; B03C 1/0332; B03C 1/288; B03C 2201/20; B03C 1/18
See application file for complete search history.

(56) References Cited

U.S. PATENT DOCUMENTS 4,367,143 A 1/1983 Carpenter
4,657,666 A 4/1987 Snook et al.
(Continued)

FOREIGN PATENT DOCUMENTS

AU 2011224015 A1 4/2012
CA 2832814 A1 10/2012
(Continued)

OTHER PUBLICATIONS

U.S. Appl. No. 15/528,952.
(Continued)

*Primary Examiner* — Charles A Fox
*Assistant Examiner* — Kalyanavenkateshware Kumar
(74) *Attorney, Agent, or Firm* — Faegre Drinker Biddle & Reath LLP

(57) ABSTRACT

Magnetic arrangement for transporting magnetized material, comprising a device for conveying a magnet arrangement for transporting magnetized material and a magnetized material separating device having an improved configuration of a magnet arrangement.

23 Claims, 7 Drawing Sheets

(51) Int. Cl.
*B03C 1/034* (2006.01)
*B03C 1/28* (2006.01)

(52) U.S. Cl.
CPC ..... *B03C 2201/18* (2013.01); *B03C 2201/20* (2013.01)

(56) References Cited

U.S. PATENT DOCUMENTS

| | | | | |
|---|---|---|---|---|
| 4,946,590 | A | 8/1990 | Hertzog | |
| 5,200,071 | A | 4/1993 | Spiegel | |
| 8,329,039 | B2 | 12/2012 | Domke et al. | |
| 8,342,336 | B2 | 1/2013 | Diez et al. | |
| 8,377,311 | B2 | 2/2013 | Domke et al. | |
| 8,377,312 | B2 | 2/2013 | Domke et al. | |
| 8,377,313 | B2 | 2/2013 | Domke et al. | |
| 8,434,623 | B2 | 5/2013 | Domke et al. | |
| 8,486,270 | B2 | 7/2013 | Rieger et al. | |
| 8,584,863 | B2 | 11/2013 | Bender et al. | |
| 8,715,494 | B2 | 5/2014 | Danov et al. | |
| 8,840,794 | B2 | 9/2014 | Danov et al. | |
| 8,858,801 | B2 | 10/2014 | Domke et al. | |
| 9,028,687 | B2 | 5/2015 | Goraj | |
| 9,028,699 | B2 | 5/2015 | Danov et al. | |
| 9,126,206 | B2 | 9/2015 | Hartmann et al. | |
| 2006/0038648 | A1* | 2/2006 | Humphries | B03C 1/0332 335/306 |
| 2008/0149549 | A1* | 6/2008 | Lee | B03C 1/288 210/223 |
| 2011/0168618 | A1 | 7/2011 | Danov et al. | |
| 2011/0174710 | A1 | 7/2011 | Hartmann et al. | |
| 2011/0240527 | A1 | 10/2011 | Domke et al. | |
| 2011/0272623 | A1 | 11/2011 | Domke et al. | |
| 2012/0132032 | A1 | 5/2012 | Domke et al. | |
| 2012/0228413 | A1 | 9/2012 | Rieger et al. | |
| 2012/0255913 | A1* | 10/2012 | Tung | B03C 1/0332 210/695 |
| 2013/0087505 | A1 | 4/2013 | Danov et al. | |
| 2013/0256233 | A1 | 10/2013 | Danov et al. | |
| 2013/0313177 | A1 | 11/2013 | Danov et al. | |
| 2014/0144827 | A1* | 5/2014 | Marchand | B03C 1/0332 210/222 |
| 2014/0374325 | A1* | 12/2014 | Jung | B03C 1/0332 209/212 |
| 2016/0008821 | A1* | 1/2016 | Yount | B03C 1/0332 210/222 |

FOREIGN PATENT DOCUMENTS

| | | | |
|---|---|---|---|
| DE | 102010023130 | A1 | 12/2011 |
| DE | 202011104707 | A1 | 2/2012 |
| DE | 102010061952 | A1 | 5/2012 |
| EP | 1974821 | A1 | 10/2008 |
| JP | 3824365 | B2 | 9/2006 |
| SU | 1212969 | A1 | 2/1986 |
| WO | WO-020066168 | A1 | 8/2002 |
| WO | WO-2009065802 | A2 | 5/2009 |
| WO | WO-2009101070 | A2 | 8/2009 |
| WO | WO-2010007075 | A1 | 1/2010 |
| WO | WO-2010007157 | A1 | 1/2010 |
| WO | WO-2010031617 | A1 | 3/2010 |
| WO | WO-2010031679 | A1 | 3/2010 |
| WO | WO-2010066770 | A1 | 6/2010 |
| WO | WO-2010097361 | A1 | 9/2010 |
| WO | WO-2010100180 | A1 | 9/2010 |
| WO | WO-2011058039 | A1 | 5/2011 |
| WO | WO-2011107353 | A1 | 9/2011 |
| WO | WO-2011131411 | A1 | 10/2011 |
| WO | WO-2011134710 | A1 | 11/2011 |
| WO | WO-2011154178 | A1 | 12/2011 |
| WO | WO-2012104292 | A1 | 8/2012 |
| WO | WO-2012107274 | A1 | 8/2012 |
| WO | WO-2012116909 | A1 | 9/2012 |
| WO | WO-2012140065 | A1 | 10/2012 |
| WO | WO-2013038192 | A1 | 3/2013 |
| WO | WO-2013167634 | A1 | 11/2013 |
| WO | WO-2015110555 | A1 | 7/2015 |

OTHER PUBLICATIONS

U.S. Appl. No. 15/527,820.
Chinese Office Action With English Translation for Chinese Application No. 2015800162210, dated Jun. 13, 2018.
International Search Report for PCT/EP2015/055712 dated Jun. 9, 2015.

* cited by examiner

MAGNET ARRANGEMENT FOR TRANSPORTING MAGNETIZED MATERIAL

CROSS-REFERENCE TO RELATED APPLICATIONS

This application is a national stage application (under 35 U.S.C. § 371) of PCT/EP2015/055712, filed Mar. 18, 2015, which claims benefit of European Application No. 14162862.8, filed Mar. 31, 2014, both of which are incorporated herein by reference in their entirety.

FIELD OF THE INVENTION

The present invention relates to a device and method for transporting magnetized material, and in particular to a device and a method for transporting magnetized material having an optimized magnet arrangement for separating magnetized material from a dispersion.

BACKGROUND OF THE INVENTION

Processes and apparatuses for separating magnetic constituents from a dispersion which dispersion comprises magnetic constituents and non-magnetic constituents are used for a separation of ore from gangue.

For this purpose, a raw material to be separated is prepared beforehand, in that ore particles are converted into magnetic constituents. Gangue particles are provided as non-magnetic constituents. This can be reached by attaching magnetic particles to ore particles, wherein gangue particles are not attached to magnetic particles. Having provided the ore particles with magnetic properties, it is possible to separate ore particles from gangue by applying a magnetic field.

The raw material comprises ore and gangue, and after preparation comprises magnetic constituents and non-magnetic constituents. Magnetic constituents and non-magnetic constituents are brought into dispersion, so that the resulting dispersion may be forced into a flow process. The flow process allows an efficient separation process.

Processes and apparatuses for separating magnetic constituents are for example known from US 2011/1686178 A1, WO 2012/104292 A1, US 2011/0174710 A1, or U.S. Pat. No. 4,946,590 A.

US 2011/1686178 A1 describes a device for separating ferromagnetic particles from a suspension, wherein the device has a tubular reactor and a plurality of magnets which are arranged outside the reactor, wherein the magnets being movable along at least part of the length of the reactor up to the vicinity of a particle extractor by means of a rotary conveyer.

WO 2012/104292 A1 describes an apparatus for separation of magnetic constituents from a dispersion, having at least one loop-like canal through which a dispersion flows having at least two inlets and at least two outlets, wherein at least one magnet is moveable alongside the canal, wherein the canal is arranged relative to gravity in a way that non-magnetic constituents are assisted to go into at least one of the first outlet by sedimentation, and by current of the dispersion, and magnetic constituents are forced into at least one second outlet by magnetic force against a current of flushing water.

US 2011/0174710 A1 describes a separating device for separating magnetizable particles and non-magnetizable particles transported in a suspension flowing through a separating channel, having at least one permanent magnet arranged on at least one side of the separating channel for producing a magnetic field which deflects magnetizable particles to the side, wherein in addition to the permanent magnet at least one coil is provided for producing an additional field.

U.S. Pat. No. 4,946,590 A describes a clamp on magnetic water treatment device, which can be fixedly clamped on a water conduit.

SUMMARY OF THE INVENTION

The present invention provides a magnet arrangement for separating and transporting of magnetized material having a higher efficiency and improved separating and transporting properties. Further, the present invention provides a conveying device having such a magnet arrangement as well as a magnetized material separating device having such a conveying device.

It should be noted, that the following described exemplary embodiments of the invention apply also for a corresponding method and a program element, as well as a computer-readable medium having stored a program element thereon, wherein the method and the program element having implemented the method operate in analogy to the device.

According to an embodiment, there is provided a magnet arrangement for separating and transporting of magnetized material, wherein the magnet arrangement comprises a first magnet, a second magnet, a third magnet, and a fourth magnet, each of the first to fourth magnets having a first pole of a first polarity and a second pole of a second opposing polarity; a first magnetic bridge and a second magnetic bridge; a canal receiving space for receiving a longitudinal canal, the canal receiving space having a first side and an opposing second side; wherein the first magnet with the first pole is oriented toward the first side of the canal receiving space; wherein the second magnet with the second pole is oriented toward the first side of the canal receiving space; wherein the third magnet with the second pole is oriented toward the second side of the canal receiving space; wherein the fourth magnet with the first pole is oriented toward the second side of the canal receiving space; wherein the first magnetic bridge bridges the second pole of the first magnet and the first pole of the second magnet; and wherein the second magnetic bridge bridges the first pole of the third magnet and the second pole of the fourth magnet.

According to an embodiment of the invention there is provided a magnet arrangement for separating and transporting of magnetized material, the magnet arrangement comprises a first magnet having a first main magnetization direction, a second magnet having a second main magnetization direction, a third magnet having a third main magnetization direction and a fourth magnet having a fourth main magnetization direction, each magnet having a first pole of a first polarity and a second pole of a second opposing polarity; a first magnetic bridge and a second magnetic bridge; a canal receiving space for receiving a longitudinal canal, the canal receiving space having a first side and an opposing second side; wherein the first magnet with the first pole is oriented toward the first side of the canal receiving space; wherein the second magnet with the second pole is oriented toward the first side of the canal receiving space; wherein the third magnet with the second pole is oriented toward the second side of the canal receiving space; wherein the fourth magnet with the first pole is oriented toward the second side of the canal receiving space; wherein the first main magnetization direction and the second main magnetization direction point toward the first side of the canal receiving space at the same longitudinal position of the canal receiving space, wherein the third main magnetization direction and the fourth main magnetization direction point toward the second side of the canal receiving space at the same longitudinal position of the canal receiving space, wherein the first magnetic bridge bridges the second pole of the first magnet and the first pole of the second magnet; wherein the second magnetic bridge bridges the first pole of the third magnet and the second pole of the fourth magnet.

Thus, it can be achieved that magnets can efficiently be provided on both sides of a longitudinal canal, without the need to bridge the magnets on opposing sides of canal by a magnetic bridge extending from one side of the canal to the other side of the canal. This allows a flexible construction of the magnet arrangement and a reduced weight for the magnet arrangement, as no magnetic bridge between opposing sides of the canal are required. A proper focusing of the magnetic field can be achieved by providing two magnets on each side of the canal, and bridging the both magnets on one side of the canal by a respective magnetic bridge. Thus, the magnetic field can be focused and increased without the need of a magnetic bridge between one side of a canal and an opposing side of the canal. The arrangement of the first to fourth magnetic elements as described above provides regions at the canal side having an increased magnetic field strength, so that magnetized particles travelling along a longitudinal direction of the canal are attracted to the respective regions having an increased magnetic field strength at the canal side. It should be noted, that a respective canal can be received in the canal receiving space of the magnet arrangement, so that for example a canal being arranged in the canal receiving space can be replaced. When arranging at least two of the first to fourth magnets in a plane perpendicular to the extension of the canal, the separation of magnetized particles can be improved. In particular it is possible to arrange the first to fourth magnets such that the magnetizing direction or the main magnetizing direction points toward the canal. Two of the respective magnetizing directions of the first to fourth magnets can be arranged in a plane perpendicular to the extension of the canal, in order to improve the separation of magnetized particles in the canal. The first to fourth magnets may be arranged in a way that it is possible to move the first to fourth magnets along the canal. The first to fourth magnets may also be arranged in a way that it is possible to remove the first to fourth magnets from the canal. This can be done by an arrangement which allows removal of the entire four magnet arrangement or by removing the four magnets pair-wise, i.e. by dividing the four-magnet arrangement into two two-magnet arrangements for sake of removal. It is also possible to provide a plurality of four-magnet arrangements along the canal.

According to an embodiment, the first pole of the first magnet faces the second pole of the third magnet so that their respective pole faces are substantially parallel to each other, and the second pole of the second magnet faces the first pole of the fourth magnet, so that their respective pole faces are substantially parallel to each other.

Thus, it is possible to provide for example a longitudinal canal in the canal receiving space, which canal may have a rectangular cross section. The side faces of the canal in this particular embodiment may be plane and the opposing side faces of the canal may be parallel. Providing corresponding pole faces of the first to fourth magnets substantially parallel to each other allows an efficient arrangement of the magnets with respect to a canal being received in the canal receiving space. It should be noted, that alternatively a canal may also have an oval cross section or a rhomb cross section, wherein the respective magnets in this case may be oriented toward the respective side face section of the canal to be received in the canal receiving space.

According to an embodiment, the first main magnetization direction, the second main magnetization direction, the third main magnetization direction and the fourth main magnetization direction point toward each of the first side and the second side of the canal receiving space at the same longitudinal position of the canal receiving space.

When arranging four of the first to fourth magnets in a plane perpendicular to the extension of the canal, the separation of magnetized particles can be improved. In particular it is possible to arrange the first to fourth magnets such that the magnetizing direction or the main magnetizing direction points toward the canal. Four of the respective magnetizing directions of the first to fourth magnets can be arranged in a plane perpendicular to the extension of the canal, in order to improve the separation of magnetized particles in the canal.

According to an embodiment, each of the plurality of four-magnet arrangements may also be separated into a first and a second two-magnet arrangement. The first two-magnet arrangements may be arranged offset to the second two-magnet arrangements. In other words, the first two-magnet arrangements may be arranged on one side of the canal, e.g. in an equal distance, and the second two-magnet arrangements may be arranged on the other side of the canal, also with the same equal distance, but shifted/offset along the canal by a half distance. The first two-magnet arrangements each may comprise a first and second magnet as well as a first bridge, and the second two-magnet arrangements each may comprise a third and fourth magnet as well as a second bridge.

Thus, a magnetic zig-zag field can be generated in the canal. If the two-magnet arrangements are offset the distance between two opposing magnets may be enlarged, without enlarging the diameter of the canal. Further, the magnetic field between two subsequent four-magnet arrangements, i.e. a set of two two-magnet arrangements, may be smoothed.

According to an embodiment, at least one of the first magnet, the second magnet, the third magnet, and the fourth magnet is a permanent magnet.

Thus, a high efficient magnet arrangement can be provided having a high magnetic field strength. It should be noted, that also all of the first, the second, the third, and the fourth magnet may be designed as a permanent magnet or at least may comprise a permanent magnet. Further, it should be noted, that at least one of the first to fourth magnets may further be provided with an additional electromagnet, for example in form of a coil wound around the respective magnet.

According to an embodiment, the permanent magnet is a rare earth magnet, in particular an NdFeB magnet, in particular an Nd2Fe14B magnet.

Thus, a type of magnet can be used for the first to fourth magnets, having a high efficiency and high coercive field strength.

According to an embodiment, the NdFeB magnet has a magnetic field strength at a surface facing the canal receiving space of at least 0.5 Tesla, in particular of at least 1.0 Tesla.

Thus, when using these particular weight percentages of the neodymium, iron, and boron, an efficient magnet arrangement can be provided.

According to an embodiment, at least one of the magnetic bridges is made of iron or an alloy on an iron basis.

Thus, an efficient coupling of the first and second magnet one the one hand and the third and fourth magnet on the other hand can be achieved. It should be noted, that instead of iron, also other ferromagnetic materials can be used. It should be noted, that the magnetic bridges may not only consist of iron, but also may comprise additional materials, for example an alloy on an iron base.

According to an embodiment, there is provided a conveying device comprising at least one magnet arrangement as described above; and a conveyor arrangement; wherein the at least one magnet arrangement as described above is mounted to the conveyor arrangement in order to move the magnet arrangement along a canal being arranged in the canal receiving space.

Thus, an entire conveying device can be provided having at least one or a plurality of magnet arrangements as described above, so that a plurality of magnet arrangements may be arranged along a conveying track of the conveying device. It should be noted, that the first magnet and the second magnet of the magnet arrangement may be offset with respect to the third magnet and the fourth magnet of the magnet arrangement, so that the plurality of first and second magnets are interleaved with respect to the opposing plurality of the third magnets and the fourth magnets. As the first magnet and the second magnet being coupled with the first magnetic bridge on the one hand and the third magnet and the fourth magnet being coupled with the second magnetic bridge on the other hand are independent elements, those elements can be provided at the conveyer arrangement as an interleaving arrangement.

According to an embodiment, the conveyor arrangement comprises a first carrier structure and a second carrier structure, wherein the first carrier structure carries the first magnet, the second magnet and the first magnetic bridge of each of the plurality of magnet arrangements, and wherein the second carrier structure carries the third magnet, the fourth magnet and the second magnetic bridge of each of the plurality of magnet arrangements.

Thus, each carrier structure can be provided with a respective magnet unit comprising two magnets and a magnetic bridge. As an alternative, the conveyor arrangement comprises only one carrier structure, wherein the carrier structure carries on its one side the first magnet, the second magnet and the first magnetic bridge of each of the plurality of magnet arrangements, and on its other side carries the third magnet, the fourth magnet and the second magnetic bridge of each of the plurality of magnet arrangements. It should be noted, that the plurality of units comprising the first magnet, the second magnet, and the first magnetic bridge may be arranged equal-distantly along the first carrier structure and that the plurality of units comprising the third magnet, the fourth magnet, and the second magnetic bridge may also be arranged equal-distantly along the second carrier structure. The first carrier structure and the second carrier structure may be arranged to each other so that the first magnet faces the third magnet and the second magnet faces a respective fourth magnet, so that pole faces thereof are substantially parallel. Even if providing only one carrier structure, the magnets and bridges on the carrier structure may be arranged to each other so that the first magnet faces the third magnet and the second magnet faces a respective fourth magnet, so that pole faces thereof are substantially parallel. It should be noted, that the first carrier structure and the second carrier structure, or when using only one carrier structure, the both magnet units each comprising the two magnets and a bridge also can be offset with respect to each other, so that the respective units of two magnets and a magnetic bridge on the first carrier structure are interleaved with respect to the opposing magnet unit comprising two magnets and a magnetic bridge.

According to an embodiment, the first carrier structure and the second carrier structure are arranged to rotate synchronously.

Thus, with respect to the plurality of first to fourth magnets, a more or less static magnetic field constellation can be established, wherein this static magnetic field constellation rotates with respect to the longitudinal canal. It should be noted, that the first carrier structure and the second carrier structure can also be mechanically connected to each other or can be replaced by a single carrier structure, so that a synchronous rotation is guaranteed. It should be noted, that the conveyer carrier may be a chain or a belt or a plate, wherein the conveyer track may for example follow a circular line. In particular when providing a conveyer carrier in form of a plate, the plate may have a form of a circle, so that magnet arrangements being mounted to the outer edge of the circular plate of the conveyer device move along a circular line.

According to an embodiment, there is provided a magnetized material separating device comprising a conveying device as described above, and a canal having a longitudinal extension in a flow direction, wherein the canal is made of a non-magnetic material so as to allow magnetic field lines to enter the canal, wherein the conveying device is arranged so as to convey the magnet arrangements along the longitudinal extension of the canal.

Thus, a separating device is provided by introducing a canal into the canal receiving section, wherein the separating device is provided by each of the magnet arrangements being mounted to the conveying device. The canal for example can be mounted so as to maintain its position, wherein the conveying device may rotate or move so as to convey the magnets along the longitudinal extension of the canal, in particular along the side faces of the canal.

According to an embodiment, at least a part of the longitudinal extension of the canal arrangement follows at least a half of a circle line.

Thus, it can be achieved that magnets rotating with the conveying device, in particular when being arranged along a circular track onto the conveying device, move along the canal, which canal at least partially follows a circular track. It should be noted, that the canal can be for example at least ¾ of a circle line or almost an entire circle line, so that a conveying device having arranged magnets along a circular track thereon move along the canal without idling.

According to an embodiment, the canal has a rectangular cross section having a first side, a second side, a third side, and a fourth side, wherein the first side and the second side of the rectangular cross section correspond to the first side and the second side of the receiving space, respectively. According to a further embodiment, the first side and the second side are the longer sides of the rectangle.

Thus, the cross section of the canal can fit the canal receiving section of the magnet arrangement so that the magnets are arranged close to the first and second side of the canal, respectively. This allows a high efficiency and provides a high magnetic field strength at the inner walls of the canal at the first and second side, respectively.

According to an embodiment, the canal has a first duct and a second duct being parallel to the first duct, wherein the first magnet with the first pole is oriented toward the first duct, wherein the second magnet with the second pole is oriented toward the second duct, wherein the third magnet with the second pole is oriented toward the first duct and wherein the fourth magnet with the first pole is oriented toward the second duct.

Thus, separate ducts can be provided, so that the canal is a dual canal. Parallel here also means that the both ducts may follow a corresponding track beside to each other. The first duct and the second duct can be concentric, for example with the first duct having a larger diameter than the second duct, so that the side faces of the first duct and the second duct flush with respect to each other. Further, each duct can be allocated to one magnet on each side face of the duct. This may result for example in a defined single concentration area along a track along the inner wall of the side faces of the respective duct. It should be noted that canal arrangement or canal here may also be understood as two parallel ducts.

It should be noted particular inlet or outlet openings of the first duct and the second duct may be arranged as a bushing through the respective other duct in order to avoid a side inlet or side outlet, which may collide with the rotating magnet arrangements of the conveying device.

According to an embodiment, the canal includes a displacement body extending along the flow direction, wherein the field free point between the first to fourth magnets lies in the displacement body.

Thus, it can be avoided that the suspension flows through an area of the canal, which is substantially field free, which would result in a lack of separation of the magnetized material in the suspension. Instead, the displacement body may be used as a flow guide to guide the dispersion or suspension in order to optimize the separation process.

According to an embodiment, a cross section of the displacement body is formed by four concave lines, wherein each of the four concave lines substantially follow the field lines of the magnet arrangement.

Thus, the displacement body allows a movement of the magnetized particles in the dispersion to move only along a tangential direction of the concave faces of the displacement body. It should be noted, that the displacement body may have an extension so as to extend to the inner side walls of the canal. In this case it is relevant that third and fourth lines are concave as described above, and that the first and second lines are no longer in contact with the dispersion, so that the shape of the first and second line may be of less relevance. Alternatively, the displacement body may be narrower than the inner width of the canal, wherein the displacement body in this particular case will be suspended by suspension devices as spacers to keep the displacement body in position within the canal.

According to an embodiment, the canal is substantially made either of a fiber reinforced plastic, a glass, or an austenitic stainless steel.

Thus, the propagation of a magnetic field is not disturbed.

It should be noted, that the above features may also be combined. The combination of the above features may also lead to synergetic effects, even if not explicitly described in detail. These and other aspects of the present invention will become apparent from and elucidated with reference to the embodiments described hereinafter.

BRIEF DESCRIPTION OF THE DRAWINGS

Exemplary embodiments of the present invention will be described in the following with reference to the following drawings.

DETAILED DESCRIPTION OF EXEMPLARY EMBODIMENTS

Figure 1:
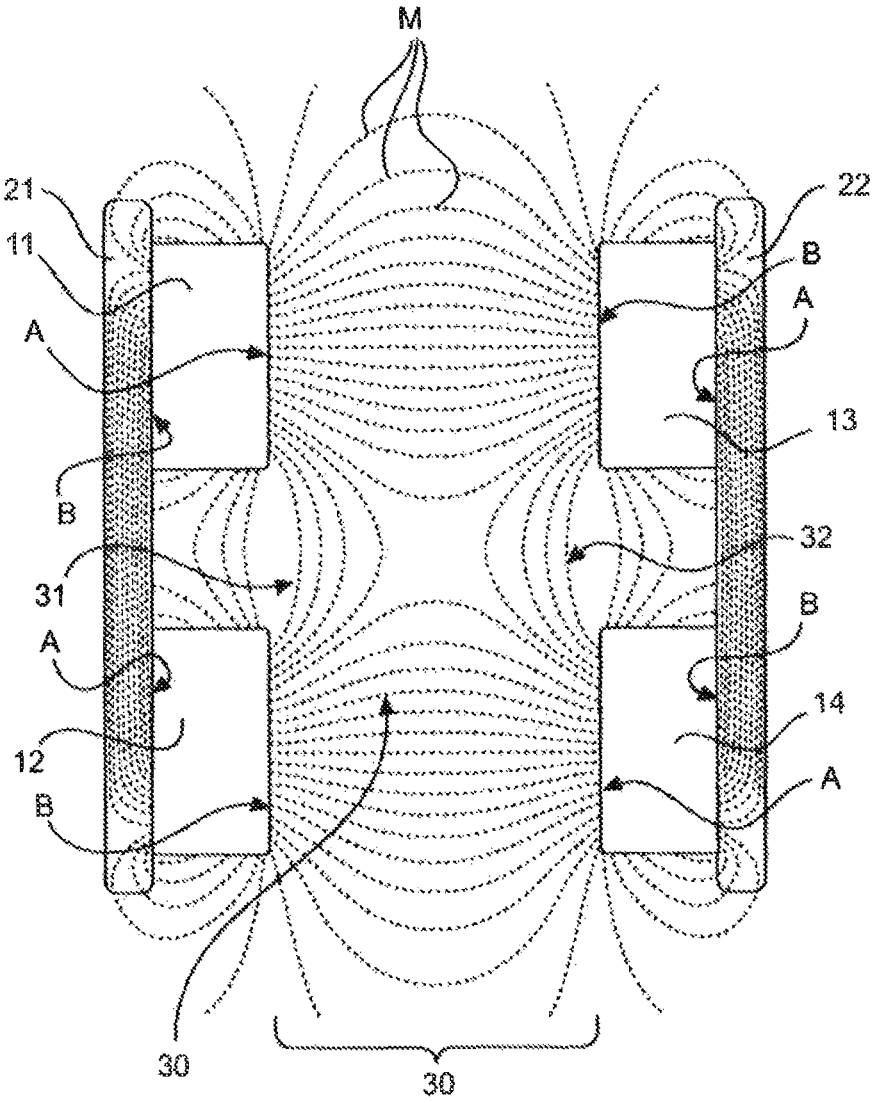
FIG. 1 illustrates a cross-sectional view of a magnet arrangement having a canal receiving space without canal therein, according to an exemplary embodiment.

FIG. 1 illustrates a cross-sectional view of a magnet arrangement, having a first magnet 11 and a second magnet 12, as well as a third magnet 13 and a fourth magnet 14. The first magnet 11 and the second magnet 12 are magnetically bridged by a magnetic bridge 21. At the same time, the third magnet 13 and the fourth magnet 14 are magnetically bridged by a magnetic bridge 22. Each of the magnets 11, 12, 13, 14 have a polarity with a first pole A and a second pole B. The magnets are arranged such that the first pole A of the first magnet 11 is oriented toward a canal receiving space 30, and vis-à-vis to a second pole B of the third magnet 13, which is also oriented toward the canal receiving space 30. At the same time, a second pole B of the second magnet 12 is oriented toward the canal receiving space 30, as well as a first pole A of the fourth magnet 14 is oriented toward the canal receiving space and here substantially parallel to the second pole of the second magnet 12. Thus, the pole faces of the magnets being oriented toward the canal receiving space are substantially parallel to each other, so that a rectangular canal can be arranged between the magnets, i.e. the pole faces of the magnets. The magnets 11, 12, 13, 14 in FIG. 1 are of the same size, however, it should be understood, that the magnet size may also be different. Further, it should be noted, that the opposing poles facing the magnetic bridge 21, 22 may also be inclined, depending on the shape of the magnetic bridge 21, 22. The magnetic bridges 21, 22 in FIG. 1 have a size so as to extend over the outer dimension of the magnets, which is symmetrical. However, it should be understood, that the magnetic bridges 21, 22 may in at least one direction extend in a measure, so that the magnetic bridge may also serve as a mounting element so as to mount the magnet arrangement to a carrier or conveyer arrangement. It should be noted that the first and second magnet and the first magnetic bridge may also be formed as a one-piece element, and may also be formed integrally. The same is valid for the third and fourth magnet and the second bridge.

As can be seen in FIG. 1, the magnet arrangement generates a magnetic field with field lines M which is illustrated by dotted lines in FIG. 1. The arrangement of FIG. 1 results in a magnetic field, which is at strongest at the pole faces facing the canal receiving space 30. The canal receiving space has a first side 31 being allocated to the first and second magnet 11, 12, and a second side 32 being allocated to the third and fourth magnet 13, 14. The canal receiving space 30 serves for receiving a canal, which in FIG. 1 may be for example a canal having a rectangular cross section. It should be understood that a canal may have one or two or more separated ducts, as will be illustrated in FIG. 2. It should be noted, that the canal may also have a round or oblong or oval cross-sectional shape, wherein in such cases, the orientation of the pole faces of the magnets being oriented toward the canal receiving space and may be inclined or modified. The pole faces may also have a contour corresponding to that of a facing outer canal surface.

Figure 2:
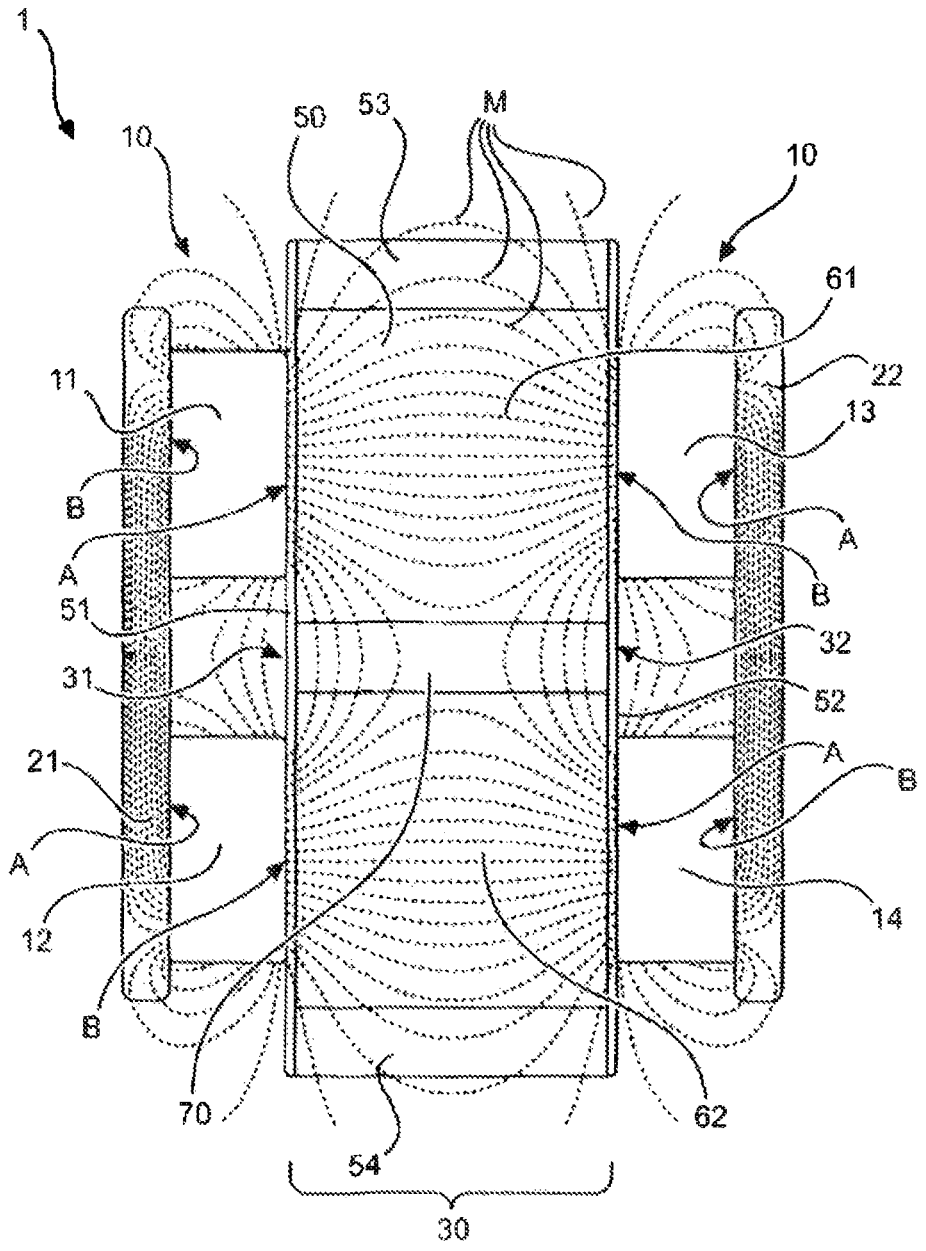
FIG. 2 illustrates a cross-sectional view of a magnetized material separating device having a magnet arrangement and a canal arranged in the canal receiving space according to an exemplary embodiment.

FIG. 2 illustrates a magnet arrangement having a canal 50 arranged in the canal receiving space 30. The magnet arrangement together with the canal forms a magnetized material separating device. The magnet arrangement is similar to that of FIG. 1, wherein same references refer to same elements. The canal in FIG. 2 has a first side 51 corresponding to the first side 31 of the canal receiving space, and a second side 52 corresponding to the second side 32 of the canal receiving space 30. Although in FIG. 2 it appears that there is no gap between the outer surface of the canal at the sides 51 and 52 over the pole faces A and B of magnets 11, 12, 13, 14, there is a minimal space between the outer surface of the canal and the respective pole faces of the magnets, as the magnet arrangement including the magnets 11, 12, 13, 14 is moved along the side surfaces 51, 52 of the canal. The canal 50 has a third side 53 and a fourth side 54 being oriented to the top and the bottom in FIG. 2. In FIG. 2, the canal 50 comprises a first duct 61 and a second duct 62, and a separator 70 being arranged between the first duct 61 and the second duct 62. Thus, the ducts 61 and 62 are separated from each other. This avoids unintended turbulences and provides an effective flow guidance of a suspension/dispersion comprising the magnetized particles (ore) and the non-magnetic particles (gangue). The magnetic bridges 21 and 22 concentrate the magnetic field lines so as to provide a higher efficiency of the magnetic field in the canal 50, in particular to the inner surface of the ducts 61, 62 to which the magnetized particles are attracted by the magnets 11, 12, 13, 14. It should be noted that the magnets for all embodiments may have shape so as to be tapered toward the pole face facing the canal in order to increase the magnetic field strength.

Figure 3:
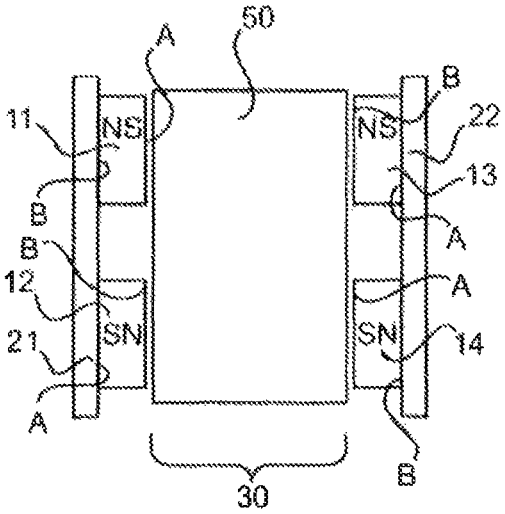
FIG. 3 illustrates a schematic overview on a magnet configuration with respect to a canal in a cross-sectional view according to an exemplary embodiment.

FIG. 3 illustrates an exemplary embodiment of a magnet configuration with north poles N and south poles S. FIG. 3 illustrates that a south pole S corresponds to the first pole A and a north pole N corresponds to the second pole B. Thus, in correspondence to FIGS. 1 and 2, a south pole S of the first magnet 11, a north pole N of the second magnet 12, a north pole N of the third magnet 13 and a south pole S of the fourth magnet 14 face the canal 50 being arranged in the canal receiving space 30.

Figure 4:
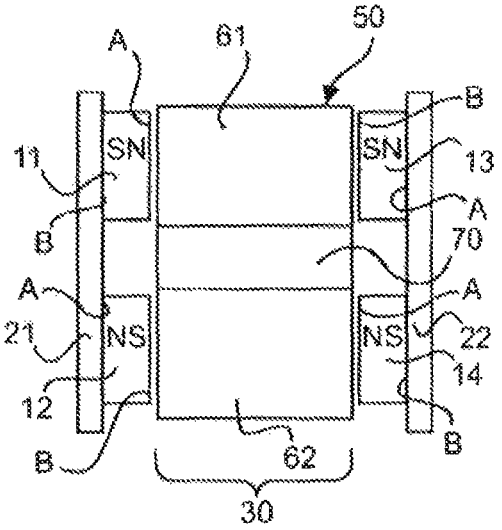
FIG. 4 illustrates a further alternative magnet configuration with respect to a canal in a cross-sectional view according to an exemplary embodiment, wherein the canal has a separator.

FIG. 4 illustrates an alternative magnet arrangement having allocated the north pole N to the first pole A and the south pole S to the second pole B. With this respect, the north pole N of the first magnet 11, the south pole S of the second magnet 12, the south pole S of the third magnet 13, and the north pole N of the fourth magnet 14 face the canal 50. It should be noted, that this magnet configuration can also be applied to the canal configuration of FIG. 3. In FIG. 4, the canal is separated into two ducts 61, 62 having a separator or displacement body 70 arranged there-between. It should be noted, that such canal arrangement can also be applied to the magnet arrangement according to FIG. 3.

Figure 5:
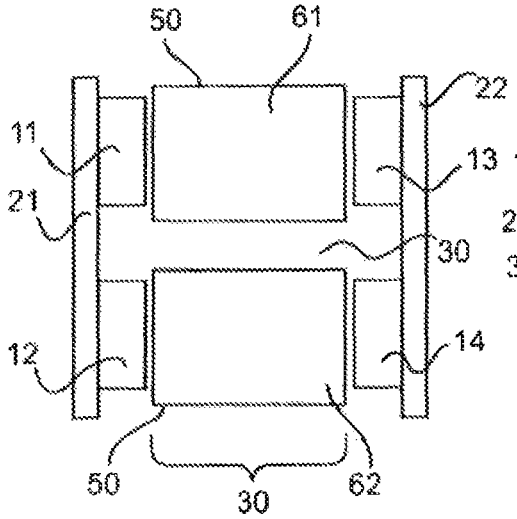
FIG. 5 illustrates a cross-sectional view having two separated canal ducts according to an exemplary embodiment.

FIG. 5 illustrates a magnet arrangement having a canal 50, which comprises two separated ducts 61, 62. The magnet arrangement may be a magnet arrangement according to FIG. 3 or 4. In other words, there is not connected canal but a space there-between. Nevertheless, there may be provided supporting elements keeping the both ducts 61, 62 in position with respect to each other.

Figure 6:
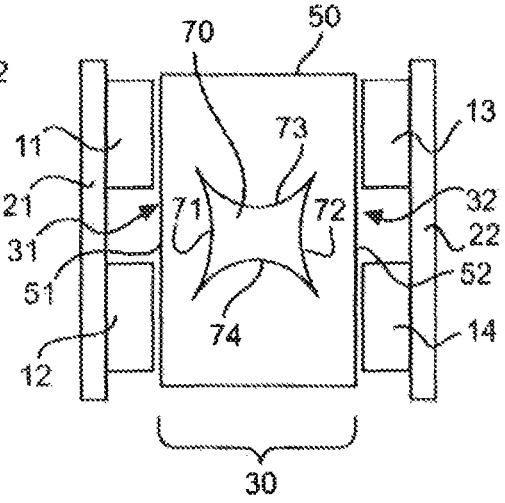
FIG. 6 illustrates an exemplary embodiment of a configuration, wherein the canal includes a displacement body of a particular shape.

FIG. 6 illustrates a further exemplary embodiment, wherein the magnet arrangement may be a magnet arrangement according to FIG. 3 or FIG. 4. In FIG. 6, the canal 50 is a canal having a larger cross-section, however having a displacement body 70 arranged therein. The displacement body 70 has a particular shape so as to support a flow guidance of the suspension/dispersion through the canal 50. The displacement body 70 in FIG. 6 has a first side 71, a second side 72, corresponding to the sides 51, 52 of the canal and the sides 31, 32 of the canal receiving space. The particular shape of the displacement body 70 will be described with respect to FIG. 7 in more detail.

Figure 7:
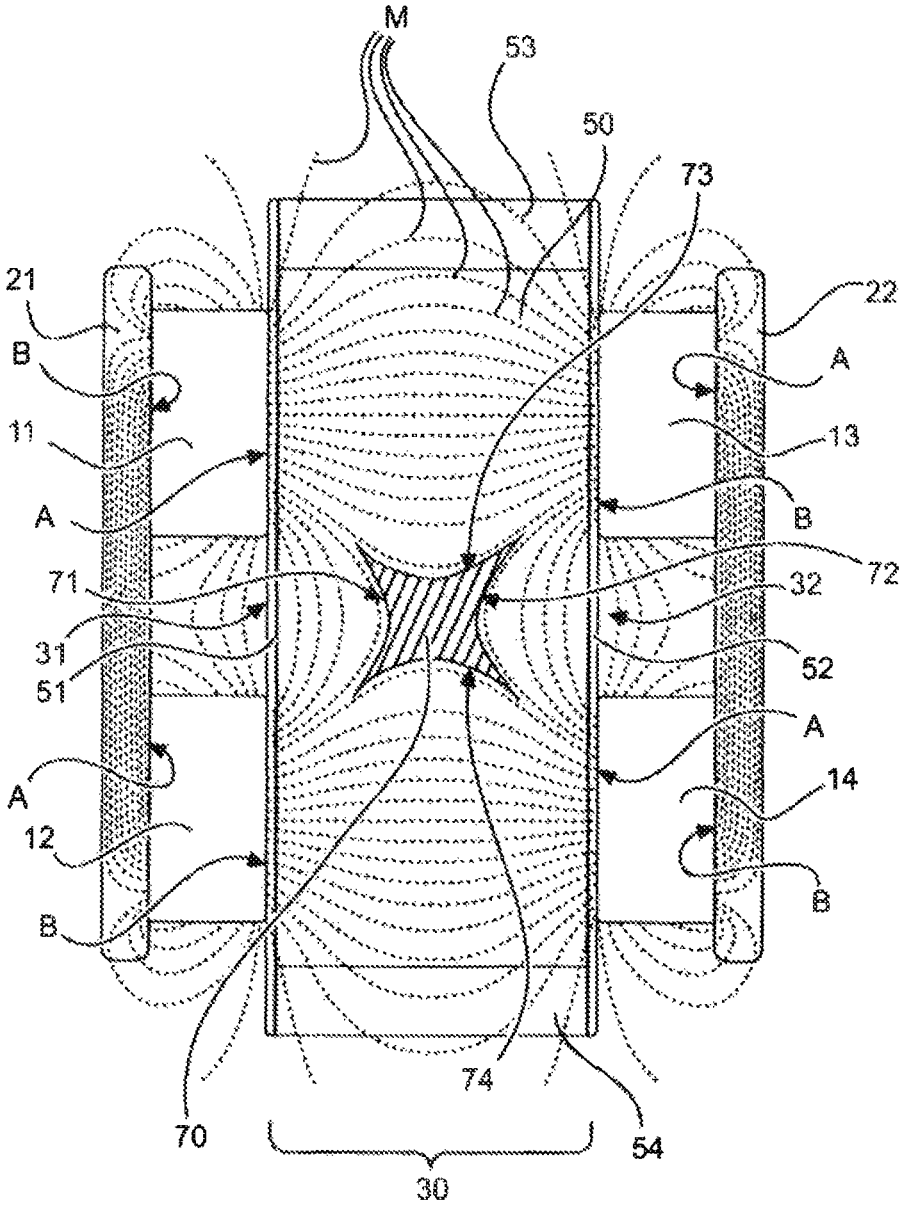
FIG. 7 illustrates a cross-sectional view according to an exemplary embodiment, wherein a displacement body is provided in the canal including an illustration of the magnetic field lines.

FIG. 7 illustrates a magnet arrangement having a canal 50 arranged in the canal receiving space 30. FIG. 7 differs from FIG. 2 by the configuration of the canal cross section, but is similar with respect to the magnet arrangement. The canal in FIG. 7 has a large cross section being separated by a displacement body 70. It should be noted, that the displacement body may have a dimension so that in FIG. 7, the upper volume of the canal 50 and the lower volume of the canal 50 are in communication to each other, as illustrated in FIG. 7. The side faces 71, 72, 73, 74 of the displacement body 70 have a concave shape so as to follow the field lines of the magnet field M. Thus, the displacement body avoids presence of the material to be separated in an area of the canal, where the field strength is low or zero. The concave side faces of the displacement body 70 follow the field lines, so that the magnetic particles close to the displacement body travel tangentially substantially without turbulences. Thus, an improved separation process can be achieved. However, the displacement body 70 alternatively may have a size so as to extend to the side walls 51, 52 of the canal, so that the displacement body 70 may also separate the upper part of the canal and the lower part of the canal without liquid communication there-between, which, however, is not illustrated in FIG. 7. In this case only the upper and lower faces 73 and 74 may be concave so as to follow a field line, whereas the side faces 71, 72 may of less relevance, in particular when side faces are not in contact with suspension/dispersion.

The suspension/dispersion including the magnetized particles flows into the plane of the FIGS. 1 to 7, so that application of a magnetic field results in an attraction of the magnetic particles to the inner side wall sections 51, 52 of the canal 50. The collected magnetic particles travel, when being attracted to the side walls by the magnets 11, 12, 13, 14 in the same speed as the magnet arrangement travels with respect to the canal 50. It should be noted, that the velocity of the suspension/dispersion including the magnetic particles may travel faster than the magnet arrangement travels with respect to the canal 50. At a particular section of the canal, the magnetic particles being accumulated at the inner side surfaces of the canal 50 opposite to the respective pole faces of the magnets, and will be guided out of the canal through a particular exit for magnetized particles of the canal.

Figure 8:
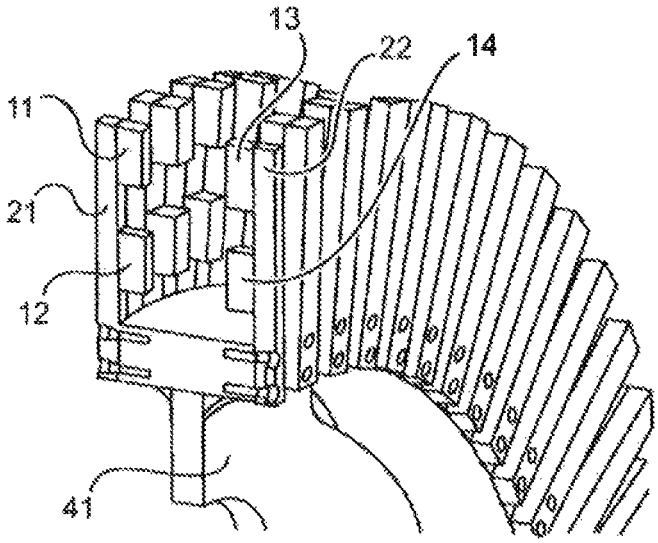
FIG. 8 illustrates a perspective view of a conveyer arrangement having mounted thereon a plurality of magnet arrangements according to an exemplary embodiment.

FIG. 8 illustrates a mounting of the magnet arrangement onto a carrier 41 of a conveying arrangement 45. FIG. 8 illustrates an embodiment, where the first magnet 11 and second magnet 12 are mounted to a first magnetic bridge 21, and the third magnet 13 and the fourth magnet 14 are mounted to a second magnetic bridge 22. The bridges 21, 22 are mounted to the carrier 41. It should be noted that the first and second magnet and the first bridge may also be mounted to a first carrier and the third and fourth magnet and the second magnetic bridge may be mounted to a second carrier. FIG. 8 illustrates that a plurality of magnet arrangements as described above are mounted on the carrier 41. The carrier 41 may be for example a wheel so that a canal being arranged in the canal receiving space (the canal is not illustrated in FIG. 8) so that the magnets can be moved along the canal along a circular track. Although FIG. 8 illustrates magnets 11 and 12 vis-à-vis magnets 13 and 14, it is also possible to arrange the magnets in an interleaving manner, so that for example the second magnetic bridge 22 is offset with respect to the first magnetic bridge 21 by a half distance between two adjacent magnetic bridges 21 on one side of the carrier 41. The carrier 41 may be manufactured of aluminum. The magnetic bridges 21, 22 may be pre-mounted to a fiber reinforced material, in particular a fiber reinforced ring, as can be seen in FIG. 8. As an alternative the bridges on one side may be pre-mounted on a first fiber reinforced ring and the bridges of the other side may be pre-mounted on a second fiber reinforced ring, so that each of both fiber reinforced rings may be mounted on each of both sides of the carrier 41. The fiber reinforced ring may also serve as an isolator. The mounting may be in a way that the isolation remains even if having mounted the bridges to the fiber reinforced rings as well as having mounted the fiber reinforced rings to the carrier 41, e.g. by offset screw positions. The fiber reinforced rings may have recesses for receiving the bridges, which may simplify a positioning and aligning of the bridges.

Figure 9:
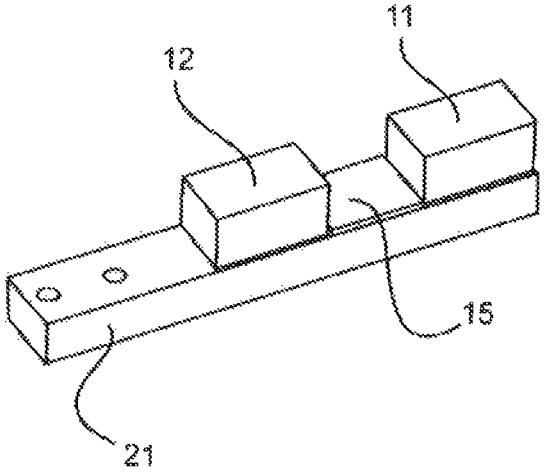
FIG. 9 illustrates a detailed perspective view of a first magnet, a second magnet and a magnetic bridge according to an exemplary embodiment.

FIG. 9 illustrates an enlarged view of a magnetic bridge 21 having mounted thereon a first magnet 11 and a second magnet 12. Between the magnets 11 and 12, there is provided a distance plate 15. The distance plate 15 allows an easier mounting, adjusting and assembling of the magnets 11, 12 onto the magnetic bridge 21. The distance plate supports a constant distance of all of the plurality of magnets of the magnet arrangements.

Figure 10:
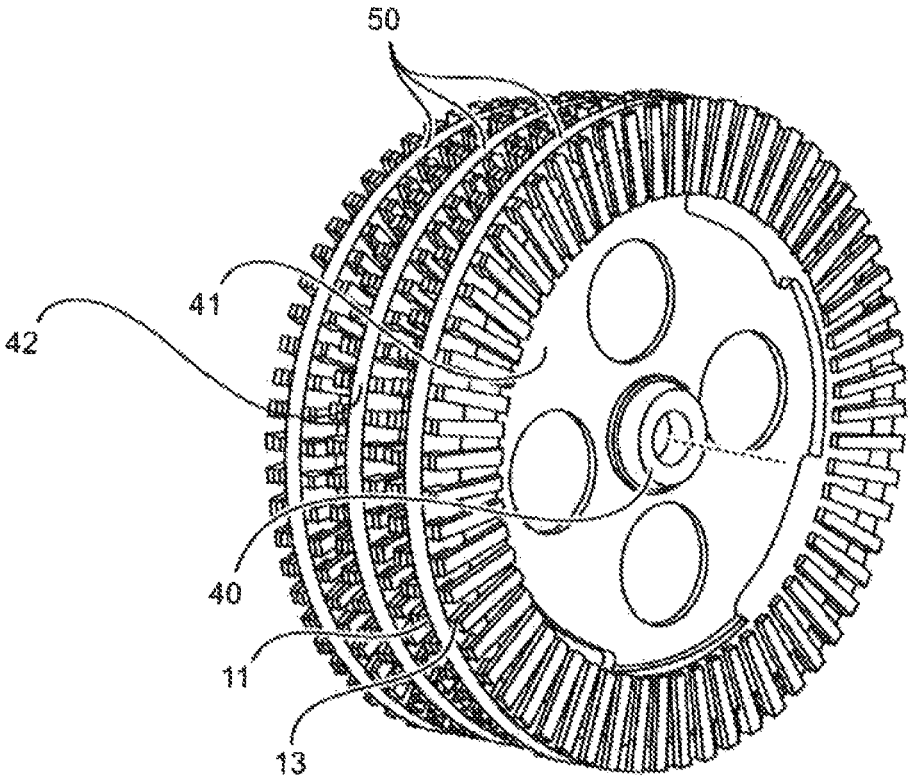
FIG. 10 illustrates an arrangement of a magnetic material separating device having a plurality of canals and a plurality of conveying devices according to an exemplary embodiment.

FIG. 10 illustrates a magnetic material separating device according to an exemplary embodiment, wherein the separating device in FIG. 10 is illustrated with three wheels which have been illustrated with respect to FIG. 8. It should be noted, that a separating device may have for example only one wheel but also more than the three illustrated wheels. The plurality of wheels may be mounted onto a single axis, so that the wheels can be driven synchronously, e.g. by a single drive unit. Thus, the magnet arrangements can be provided onto a conveying device 40 having carrier elements 41, 42. The canal 50 is arranged between the first magnet 11 and second magnet 12 on the one hand, and the third magnet 13 and the fourth magnet 14 on the other hand. It should be noted that the second and fourth magnets are not illustrated in FIG. 10, as they are hidden behind the structures. The entire device may have a plurality of carriers 41, 42.

Figure 11:
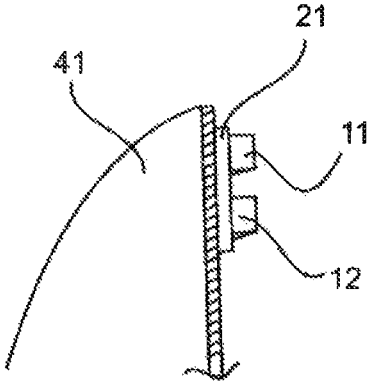
FIG. 11 illustrates a perspective sectional view of a configuration of the first and second magnet, a magnetic bridge, and a carrier element according to an exemplary embodiment.

FIG. 11 illustrates a further embodiment of a configuration of the first and second magnets 11, 12, a magnetic bridge 21, and a first carrier element 41. It should be noted, that FIG. 11 is only a schematic illustration, wherein in FIG. 11 the magnetic bridge 21 is designed as a separate element over the carrier element 41. Thus, the carrier element 41 may be for example of plastic or fiber reinforced material, having neutral magnetic properties. The magnetic field concentration is achieved by the magnetic bridge 21.

Figure 12:
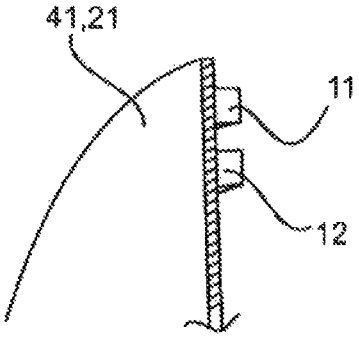
FIG. 12 illustrates a perspective cross-sectional view of a first and second magnet and a carrier element operating as a magnetic bridge according to an exemplary embodiment.

FIG. 12 illustrates a further exemplary embodiment. FIG. 12 is also a schematic illustration, wherein the carrier element 41 has magnetic properties, so as to serve as magnetic bridge 21. With this respect, the magnets 11, 12 may be directly mounted onto the carrier element 41, so as to avoid further separate elements operating as a magnetic bridge.

Figure 13:
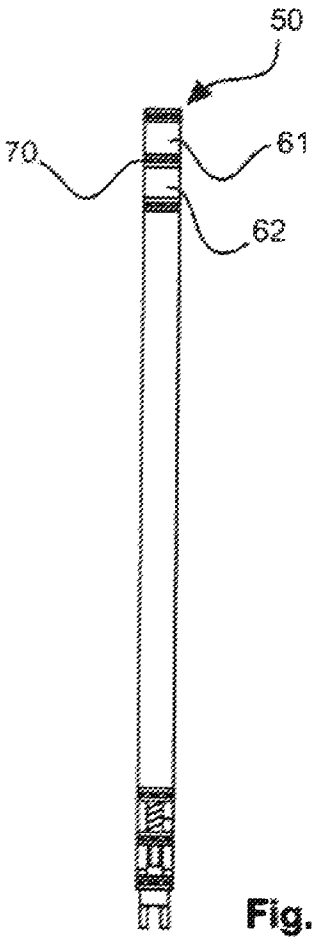
FIG. 13 illustrates a detailed view of a canal to be inserted in the canal receiving space according to an exemplary embodiment.
Figure 13:
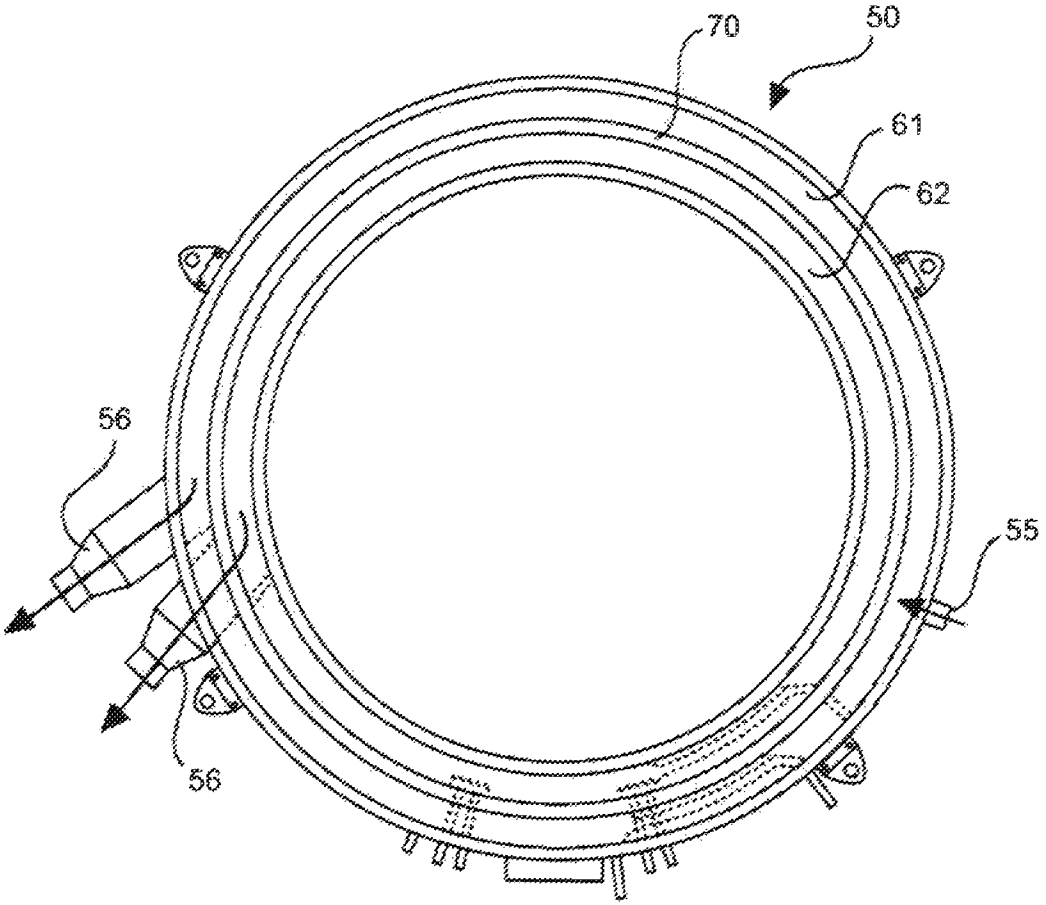

FIG. 13 illustrates an exemplary embodiment of the canal 50. In FIG. 13, the canal has two separated ducts 61, 62 with a separator 70. It should be noted, that the separator 70 in FIG. 13 is similar to that of FIG. 2, but may also be replaced by a separator according to FIG. 7. The canal 50 may have an inlet 55 for each duct 61, 62 to supply the suspension/dispersion including the magnetized particles. Each of the ducts 61, 62 also may have a water outlet 56 so as to outlet the suspension or dispersion from which the magnetized particles have been separated.

A canal as illustrated in FIG. 13 may be inserted into the arrangement which is illustrated in FIG. 8 so as to arrive at an arrangement which is illustrated in FIG. 10.

It should be noted that the term "comprising" does not exclude other elements or steps and that "a" or "an" does not exclude a plurality. Also elements described in association with the different embodiments may be combined.

It should be noted, that reference in the claims shall not be construed as limiting the scope of the claims.

REFERENCE LIST

1 magnetized material separating device
10 magnet arrangement
11 first magnet
12 second magnet
13 third magnet
14 fourth magnet
21 first magnetic bridge
22 second magnetic bridge
30 canal receiving space
31 first side of canal receiving space
32 second side of canal receiving space
40 conveying device
41 first carrier structure
42 second carrier structure
45 conveying arrangement
50 canal
51 first side of canal
52 second side of canal
53 third side of canal
54 fourth side of canal
61 first duct

62 second duct
70 displacement body
71 first side of displacement body
72 second side of displacement body
73 third side of displacement body
74 fourth side of displacement body
A first pole
B second pole
M magnetic field lines
N north pole polarity
S south pole polarity

The invention claimed is:

1. A magnet arrangement for separating and transporting of magnetized material, the magnet arrangement (10) comprises:

a first magnet (11) having a first main magnetization direction, a second magnet (12) having a second main magnetization direction, a third magnet (13) having a third main magnetization direction and a fourth magnet (14) having a fourth main magnetization direction, each magnet having a first pole (A) of a first polarity (S, N) and a second pole (B) of a second opposing polarity (N, S);

a first magnetic bridge (21) and a second magnetic bridge (22);

a canal receiving space (30) having a longitudinal axis for receiving a longitudinal canal, the canal receiving space (30) having a first side (31) and an opposing second side (32);

wherein the first magnet (11) with the first pole (A) is oriented toward the first side (31) of the canal receiving space (30);

wherein the second magnet (12) with the second pole (B) is oriented toward the first side (31) of the canal receiving space (30);

wherein the first magnet (11) and the second magnet (12) are located at the same longitudinal position with respect to the longitudinal axis;

wherein the third magnet (13) with the second pole (B) is oriented toward the second side (32) of the canal receiving space (30);

wherein the fourth magnet (14) with the first pole (A) is oriented toward the second side (32) of the canal receiving space (30);

wherein the third magnet (13) and the fourth magnet (14) are located at the same longitudinal position with respect to the longitudinal axis;

wherein the first main magnetization direction and the second main magnetization direction point toward the first side of the canal receiving space at the same longitudinal position of the canal receiving space, wherein the third main magnetization direction and the fourth main magnetization direction point toward the second side of the canal receiving space at the same longitudinal position of the canal receiving space, wherein the first magnetic bridge (21) bridges the second pole (B) of the first magnet (11) and the first pole (A) of the second magnet (12);

wherein the second magnetic bridge (22) bridges the first pole (A) of the third magnet (13) and the second pole (B) of the fourth magnet (14).

2. The magnet arrangement according to claim 1, wherein the first pole (A) of the first magnet (11) faces the second pole (B) of the third magnet (13) so that their respective pole faces are substantially parallel to each other, and the second pole (B) of the second magnet (12) faces the first pole (A) of the fourth magnet (14), so that their respective pole faces are substantially parallel to each other.

3. The magnet arrangement according to claim 1, wherein the first main magnetization direction, the second main magnetization direction, the third main magnetization direction and the fourth main magnetization direction point toward each of the first side and the second side of the canal receiving space at the same longitudinal position of the canal receiving space.

4. The magnet arrangement according to claim 1, wherein at least one of the first magnet (11), the second magnet (12), the third magnet (13) and the fourth magnet (14) is a permanent magnet, wherein the permanent magnet is a rare earth magnet, in particular a NdFeB magnet, in particular a Nd2Fe14B magnet.

5. The magnet arrangement according to claim 4, wherein the permanent magnet is a NdFeB magnet and the NdFeB magnet has a magnetic field strength at a surface facing the canal receiving space of at least 0.5 Tesla, in particular of at least 1.0 Tesla.

6. The magnet arrangement according to claim 1, wherein at least one of the magnetic bridges (21, 22) is made of an alloy on an iron basis.

7. A conveying device comprising:

at least one magnet arrangement (10) according to claim 1;

a conveyor arrangement (45);

wherein the at least one magnet arrangement (10) is mounted to the conveyor arrangement (45) in order to move the magnet arrangement (10) along a canal being arranged in the canal receiving space (30).

8. The conveying device according to claim 7, wherein the conveyor arrangement (45) comprises a single carrier structure (41) wherein the carrier structure (41) on one side carries the first magnet (11), the second magnet (12) and the first magnetic bridge (21) of each of a plurality of magnet arrangements (10), and wherein the carrier structure (41) on an opposing side carries the third magnet (13), the fourth magnet (14) and the second magnetic bridge (22) of each of a plurality of magnet arrangements (10).

9. The conveying device according to claim 7, wherein the conveyor arrangement (45) comprises a first carrier structure (41) and a second carrier structure (42), wherein the first carrier structure (41) carries the first magnet (11), the second magnet (12) and the first magnetic bridge (21) of each of a plurality of magnet arrangements (10), and wherein the second carrier structure carries the third magnet (13), the fourth magnet (14) and the second magnetic bridge (22) of each of a plurality of magnet arrangements (10).

10. The conveying device according to claim 9, wherein the first carrier structure (41) and the second carrier structure (42) are arranged to rotate synchronously.

11. A magnetized material separating device (1) comprising:

a conveying device (40) according to claim 7, a canal (50) having a longitudinal extension in a flow direction, wherein the canal is made of a non-magnetic material so as to allow magnetic field lines to enter the canal (50);

wherein conveying device (40) is arranged so as to convey the magnet arrangements (10) along the longitudinal extension of the canal (50).

12. The magnetized material separating device according to claim 11, wherein at least a part of the longitudinal extension of the canal arrangement follows at least a half of a circle line.

13. The magnetized material separating device according to claim 11, wherein the canal (50) has a rectangular cross section having a first side (51), a second side (52), a third side (53) and a fourth side (54), wherein the first side (51) and the second side (52) are the longer sides of the rectangle, wherein the first side (51) and the second side (52) of the rectangular cross section corresponds to the first side (31) and the second side (32) of the receiving space (30), respectively.

14. The magnetized material separating device according to claim 11, wherein the canal (50) has a first duct (61) and a second duct (62) being parallel to the first duct (61), wherein the first magnet (11) with the first pole (A) is oriented toward the first duct (61), wherein the second magnet (12) with the second pole (B) is oriented toward the second duct (32), wherein the third magnet (13) with the second pole (B) is oriented toward the first duct (61) and wherein the fourth magnet (14) with the first pole (A) is oriented toward the second duct (62).

15. The magnetized material separating device according to claim 11, wherein the canal (50) includes a displacement body (70) extending along the flow direction, wherein a field free point between the first to fourth magnets lies in the displacement body (70).

16. The magnetized material separating device according to claim 15, wherein a cross section of the displacement body (70) is formed by four concave lines (71, 72, 73, 74), wherein each of the four concave lines (71, 72, 73, 74) substantially follow the field lines (M) of the magnet arrangement (10).

17. The magnetized material separating device according to claim 11, wherein the canal is made either of a fiber reinforced plastic, a glass, or an austenitic stainless steel.

18. The magnet arrangement according to claim 1, wherein the first bridge (21) is further from the canal than the first magnet (11) and the second magnet (12), and the second bridge (22) is further from the canal than the third magnet (13) and the fourth magnet (14).

19. The magnet arrangement according to claim 1, wherein the first bridge (21) and the second bridge (22) are separated and spaced from each other.

20. The magnet arrangement according to claim 1, wherein the first magnet (11) and the second magnet (12) are mounted to the first bridge (21) to form a separate unit adapted to be mounted as a unit to a first carrier structure, and the third magnet (13) and the fourth magnet (14) are mounted to the second bridge (22) to form a separate unit adapted to be mounted as a unit to a second carrier structure.

21. The magnet arrangement according to claim 1, wherein the first magnet (11) and the second magnet (12) are separate from and out of contact with each other, and the third magnet (13) and the fourth magnet (14) are separate from and out of contact with each other.

22. The magnet arrangement according to claim 1, wherein the longitudinal position of the first magnet (11) and the second magnet (12) is the same as the longitudinal position of the third magnet (13) and the fourth magnet (14).

23. The magnet arrangement according to claim 1, wherein the longitudinal position of the first magnet (11) and the second magnet (12) is offset from the longitudinal position of the third magnet (13) and the fourth magnet (14).

* * * * *